US007448838B2

(12) United States Patent
Bunting

(10) Patent No.: US 7,448,838 B2
(45) Date of Patent: Nov. 11, 2008

(54) VEHICLE FOR SETTING UTILITY POLES IN A REMOTE LOCATION

(75) Inventor: Nathan Bunting, Red Bluff, CA (US)

(73) Assignee: Linecat, Inc., Red Bluff, CA (US)

( * ) Notice: Subject to any disclaimer, the term of this patent is extended or adjusted under 35 U.S.C. 154(b) by 175 days.

(21) Appl. No.: 11/300,679

(22) Filed: Dec. 13, 2005

(65) Prior Publication Data

US 2007/0134075 A1 Jun. 14, 2007

(51) Int. Cl.
*B66F 11/00* (2006.01)

(52) U.S. Cl. ..... 414/23; 173/28; 212/180

(58) Field of Classification Search ..... 414/23; 212/180, 285, 305; 173/28
See application file for complete search history.

(56) References Cited

U.S. PATENT DOCUMENTS

| | | | | |
|---|---|---|---|---|
| 2,713,218 | A * | 7/1955 | Dyer | 172/438 |
| 2,814,396 | A | 11/1957 | Neale, Sr. | |
| 2,846,094 | A * | 8/1958 | Pilch | 414/686 |
| 3,058,533 | A * | 10/1962 | Collins, Jr. | 175/85 |
| 3,161,301 | A | 12/1964 | Versch | |
| 3,236,316 | A | 2/1966 | Dorkins et al. | |
| 3,252,523 | A | 5/1966 | Kachnik et al. | |
| 3,252,526 | A | 5/1966 | Verrell et al. | |
| 3,262,582 | A | 7/1966 | Pitman et al. | |
| 3,306,373 | A | 2/1967 | Pitman et al. | |
| 3,333,717 | A * | 8/1967 | Scaperotto | 414/741 |
| 3,355,040 | A * | 11/1967 | Guttridge | 414/542 |
| 3,360,055 | A | 12/1967 | Broderson | |
| 3,604,533 | A * | 9/1971 | Eckels et al. | 182/46 |
| 3,606,048 | A | 9/1971 | Long | |
| 3,631,991 | A | 1/1972 | Wacht et al. | |
| 3,690,387 | A * | 9/1972 | Dixon | 173/193 |
| 3,700,117 | A * | 10/1972 | Corley | 414/12 |
| 3,933,261 | A | 1/1976 | Marostica et al. | |
| 4,373,853 | A * | 2/1983 | Biller et al. | 414/732 |
| 4,645,410 | A | 2/1987 | Royer | |
| 4,775,276 | A | 10/1988 | McMillan | |
| 5,165,192 | A | 11/1992 | Markstrom | |
| 5,544,978 | A | 8/1996 | Albers | |
| 5,558,169 | A | 9/1996 | Madgwick et al. | |

(Continued)

FOREIGN PATENT DOCUMENTS

EP 1 604 944 A2 * 6/2005

*Primary Examiner*—Thomas J. Brahan
(74) *Attorney, Agent, or Firm*—John P. O'Banion

(57) ABSTRACT

A tracked vehicle with a front blade for clearing roads and a rear mounted crane to set and rig a utility pole in remote locations. The front blade is configured with mounts to carry an auger. A cradle on the front blade and on an outrigger of the crane is used to transport a pole. The vehicle is configured to carry all necessary accessories to the site including a pole grapple, a collapsible personnel bucket, and a water supply for cutting and/or compacting the hole. The crane folds to a compact configuration behind the cab of the tracked vehicle and, when extended, can access poles up to 85 feet tall. The crane can be operated by remote control for safe operation near energized lines or when positioned on steep terrain. The crane can be removed from the vehicle in the field for unencumbered use of the tracked vehicle and blade.

16 Claims, 8 Drawing Sheets

U.S. PATENT DOCUMENTS 6,409,457 B1 * 6/2002 Korycan et al. ..... 414/501
6,494,515 B1 * 12/2002 Kalbfleisch ..... 294/86.41
6,527,063 B2 * 3/2003 Rust et al. ..... 175/162
6,857,837 B2 2/2005 Rajewski
2005/0161654 A1 7/2005 Ancell

* cited by examiner

VEHICLE FOR SETTING UTILITY POLES IN A REMOTE LOCATION

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to a vehicle equipped to set utility poles, and more particularly to a vehicle for accessing and setting utility poles in a remote location or in adverse terrain.

2. Description of Related Art

Electric power lines are often routed through rugged and remote terrain as they connect the power generation source to the electric load or connect rural service areas. Some generation sources, such as hydroelectric and wind may themselves be located in rugged and remote locations. These remote locations are often characterized by uneven or steep terrain, dense trees and vegetation or adverse surface conditions such as mud or snow. In order to construct electric lines through these remote areas, multiple machines and vehicles are typically used. First a tracked vehicle with a blade is used to cut and compact a road or right of way, then the pole must be transported to the site on a vehicle, trailer or by dragging. A vehicle with a derrick and auger may be brought in to dig the hole and erect the pole. A third vehicle such as a derrick or crane with a bucket may be used to access and rig the top of the pole. For high voltage and transmission lines in rugged areas, equipment that can set and access poles that extend up to about 80 feet high are required. A crew of vehicle operators and utility workers, with close coordination, is required to move three or four separate vehicles in and out of a remote location. In extreme cases, poles can be brought in and set in a prepared hole by helicopter.

Utility vehicles for urban use where road access is readily available are typically limited to vertical reaches of about 35 to 60 feet and are not equipped for off road use. Existing vehicles configured for use in remote locations, such as wheeled loaders and tracked excavators, have been retrofitted with derricks or bucket booms to set and rig utility poles. Some retrofit derricks are mounted on the top of the vehicle making them top heavy and unsuitable for use in steep terrain. Other retrofitted vehicles are too large to transport on roads and highways without "wide load" signs and escorts. In all instances known to the inventor, multiple vehicles are currently required to complete the task of accessing a remote site, drilling a hole, setting and then rigging a utility pole.

Once installed, remote electric lines and their right of ways must be maintained with the same vehicle access issues. If an existing pole or power line is damaged, such as in a storm or fire, a repair crew must quickly access the site and the top of the pole and make repairs with minimum delay.

What is needed is a single vehicle that can access a remote location in adverse terrain conditions and set and rig a tall, high voltage utility pole. This vehicle should be equipped to transport the pole, dig the hole, erect the pole and provide personnel access to rig the top of the pole in a safe manner. This vehicle should also be capable of being transported on roads and highways without "wide load" signs or an escort.

BRIEF SUMMARY OF THE INVENTION

A tracked vehicle with a front blade for clearing and compacting roads and a rear mounted crane configured to set and rig a utility pole in remote and rugged locations or on adverse terrain. The front blade is configured with mounts to carry an auger. A cradle on the front blade and on an outrigger of the crane is used to transport a pole. The vehicle is configured to carry all necessary accessories to the site including a portable pole grapple, a collapsible personnel bucket, and a water supply for cutting and/or compacting the hole. Towers and masts such as used for communication can also be erected with the vehicle.

The crane folds to a compact configuration behind the cab of the tracked vehicle and, when extended, can reach up to about 85 feet tall. The crane can be operated by remote control for safe operation near energized lines or when positioned on steep terrain. The crane assembly can be removed from the tracked vehicle in the field for unencumbered use of the tracked vehicle and blade.

An embodiment of the invention is an apparatus for installing utility poles in a remote location that comprises a tracked vehicle adapted for operating in remote locations, the tracked vehicle having a front and rear, a moveable blade coupled to the front of the vehicle, an auger mount coupled to the blade, where the auger mount is adapted to support an auger while the tracked vehicle is in motion, a subframe coupled to the rear of the tracked vehicle, a folding crane mounted on the subframe, a hydraulic power source coupled to the tracked vehicle, where the hydraulic power source is adapted to power the crane, where the crane is adapted to manipulate a utility pole, and where the crane is further adapted to drive an auger.

An aspect of the invention is first and second outriggers coupled to the crane, a front pole cradle coupled to the blade, a rear pole cradle coupled to the first outrigger, and where the front, rear pole cradles are adapted to carry a utility pole.

Another aspect of the invention is where the rear pole cradle is removable from the first outrigger, and where the front pole cradle is further adapted to pivot behind the blade.

A further aspect of the invention is where the crane has an articulating member, where the subframe with the crane attached is removable from the tracked vehicle, and where the subframe and the crane are supported on the first, second outriggers and the articulating member when removed from the tracked vehicle.

A still further aspect of the invention is a water tank mounted on the vehicle, means for filling the water tank, and means for dispensing water from the water tank.

Another aspect of the invention is a removable grapple adapted to couple to the crane, where the grapple is further adapted to rotate on a hub, and where the grapple is configured to grasp a utility pole.

A further aspect of the invention is where the grapple is comprised primarily of aluminum.

A still further aspect of the invention is a collapsible personnel bucket adapted to couple to the crane, the bucket having a top frame and a floor, the personnel bucket having a pair of long sides and a pair short sides positioned between the top frame and the floor, the short sides hinged at the top frame, the long sides hinged at their center, the long sides hinged at the top frame and at the floor, the bucket having an erect position and a collapsed position, where the short sides are configured to fold inward and parallel to the top frame when the bucket is in the collapsed position, and where the long sides are configured to fold inward at their center when the bucket is in the collapsed position.

Another aspect of the invention is where the long and short sides and the floor are comprised primarily of aluminum.

A further aspect of the invention is a yoke having a fork and a tongue, the fork adapted to couple to the top frame of the collapsible bucket, the tongue adapted to couple to the crane, and where the yoke is further adapted to pivotally support the collapsible bucket in the erect position.

A still further aspect of the invention is where the tongue of the yoke is further adapted to couple to the subframe when the collapsible bucket is in a collapsed condition.

Another embodiment of the invention is a collapsible personnel bucket adapted to couple to a crane that comprises a rectangular floor, a pair of long sides and a pair short sides coupled to the floor, a top frame coupled to the pair of long sides and the pair of short sides, the short sides hinged at the top frame, the long sides hinged at their center, the long sides hinged at the top frame and at the floor, the bucket having an erect position and a collapsed position, where the short sides are configured to fold inward and parallel to the top frame when the bucket is in the collapsed position, and where the long sides are configured to fold inward at their center when the bucket is in the collapsed position.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 8C. It will be appreciated that the apparatus may vary as to configuration and as to details of the parts, and that the method may vary as to the specific steps and sequence, without departing from the basic concepts as disclosed herein.

Figure 1:
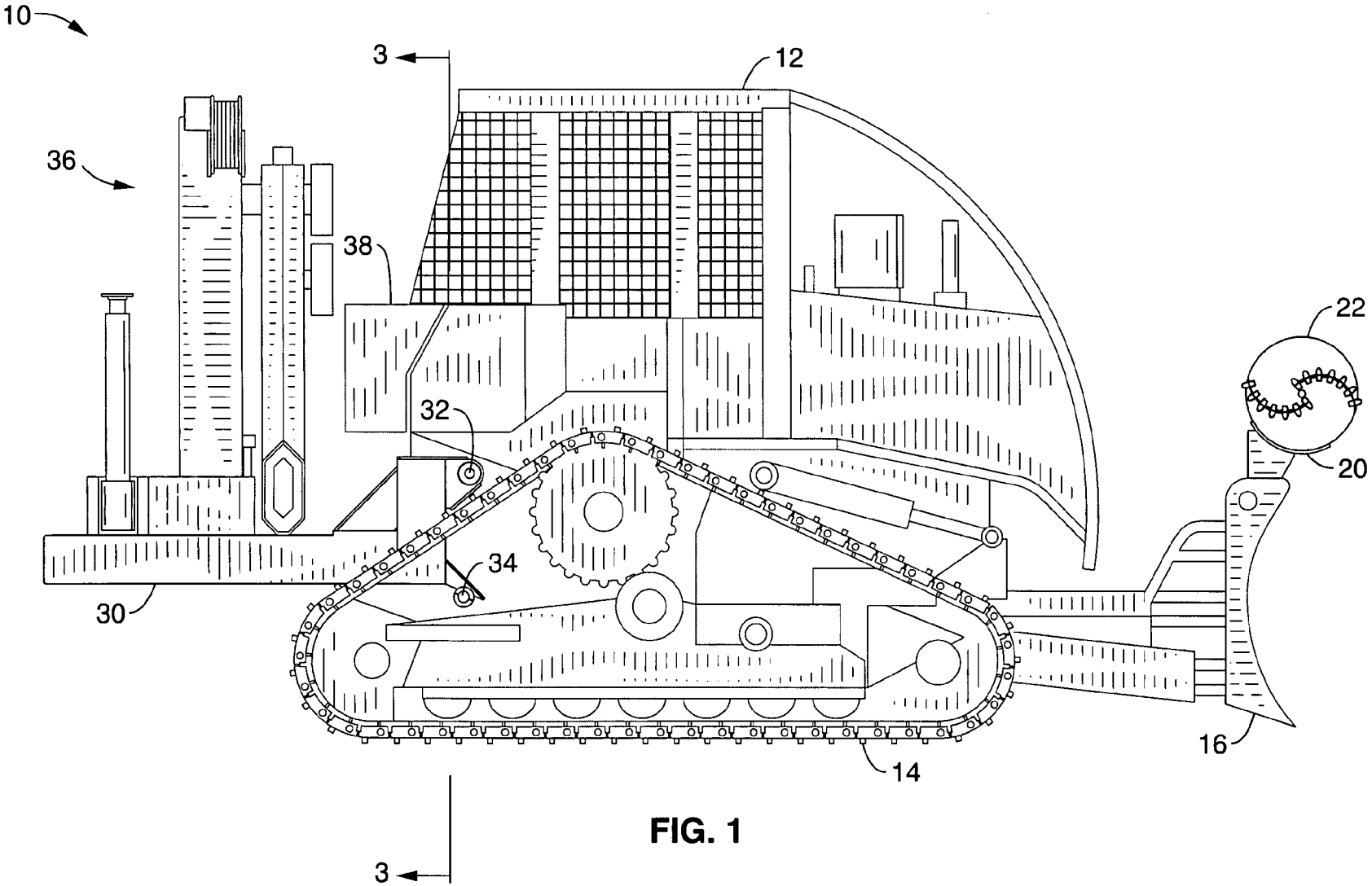
FIG. 1 illustrates a schematic view of a utility vehicle adapted for line service in remote locations according to the invention.
Figure 2:
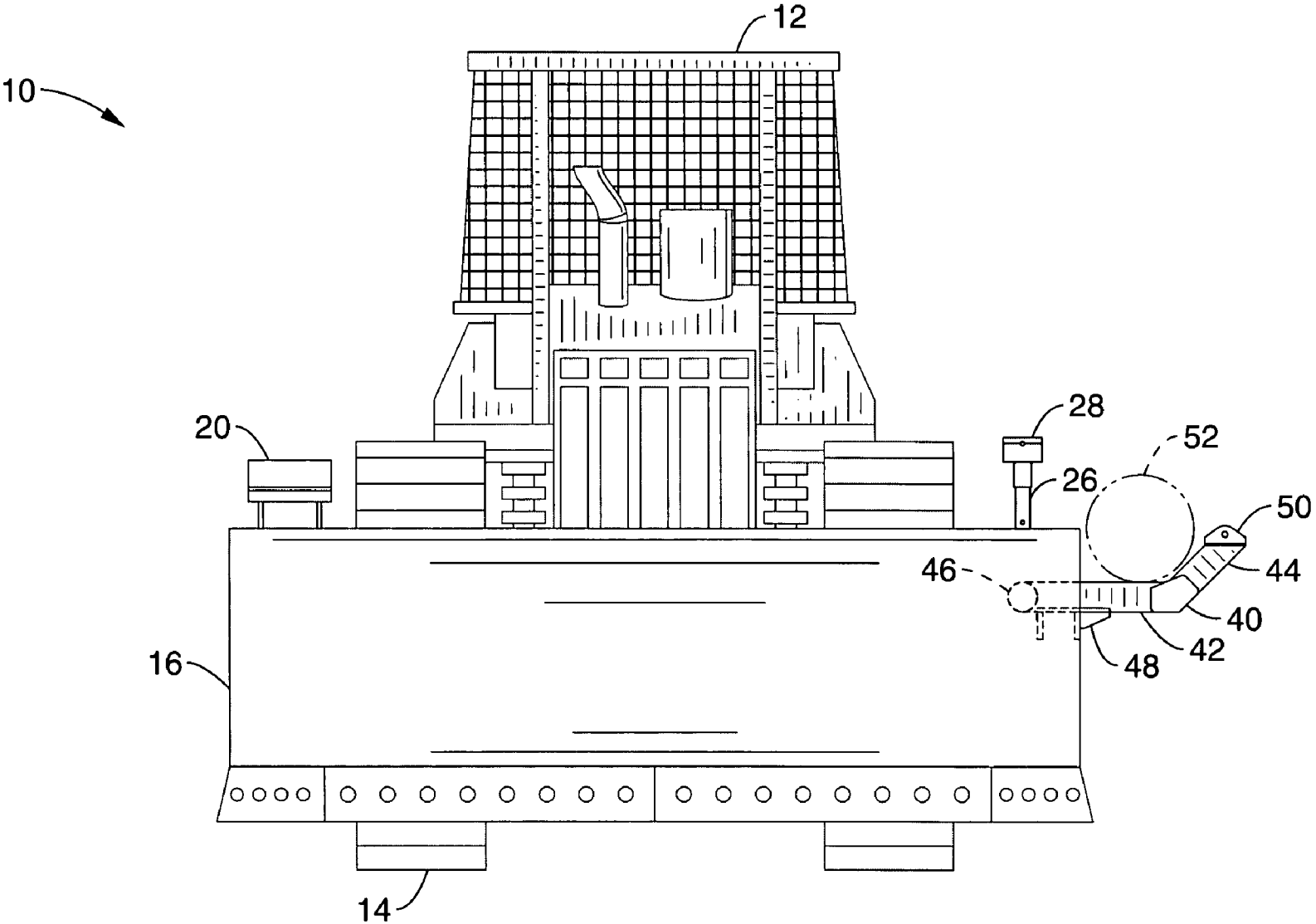
FIG. 2 is a front view of the utility vehicle shown in FIG. 1 showing the blade, auger mount and front pole cradle

FIG. 1 illustrates a schematic view and FIG. 2 illustrates a front view of a utility vehicle 10 adapted for line service in remote locations, also herein called a line cat. A Caterpillar™ 527 skidder is shown as a preferred base vehicle 12. It is a tracked vehicle configured for heavy duty forestry operations and normally comes equipped with a front blade and an optional rear log grappler. Other less preferred base vehicles include a smaller 514 skidder, a D6 or D7 Dozer, made by Caterpillar,™ or similar tracked vehicle with a front blade. Some of the characteristics of the preferred base vehicle include tracks 14 with a total track width that allows legal trailering on roads and highways without the "wide load" designation or required escort. The preferred base vehicle should have a high ground clearance, low center of gravity and a six way movable front blade 16 wider than the tracks 14 suitable for clearing and scraping a road or right of way.

Referring to FIG. 1, a semi circular auger cradle 20 is coupled to the right top of front blade 16 and used to support the blade section of a digging auger 22. In one embodiment auger cradle 20 is about 16 inches wide, welded to blade 16 and can accommodate an auger from about 12 inches in diameter to about 48 inches in diameter. An Alaskan auger 22 with a serrated tip for digging in remote and rocky terrain is shown supported on top of blade 16. Referring briefly to FIG. 2, support post 26 and adjustable auger shaft mount 28 are mounted above blade 16 on the left side to support the shaft of auger 22.

Referring back to FIG. 1, a subframe 30 is mounted to the chassis of vehicle 12 with upper support pins 32 and lower support pins 34. In a preferred embodiment, subframe 30 is fabricated from 4 by 10 inch steel box tubing about ½ inch thick and is about 40 inches wide and extends about 88 inches from the support pins 32, 34. Subframe 30 is preferably reinforced with welded gussets and cross braces. In one embodiment, subframe 30 is removable from vehicle 12 in the field by removing pins 32 and 34.

A folding crane assembly 36 is shown mounted on subframe 30. Details of folding crane assembly 36 are further described in FIG. 4. Also shown in FIG. 1 is an auxiliary hydraulic tank 38 mounted behind the cab of vehicle 12.

FIG. 2 illustrates of front view of utility vehicle 10 shown in FIG. 1 with front blade 16 configured wider than tracks 14.

From the driver's perspective, auger cradle 20 is mounted on the right top of blade 16. Support post 26 and adjustable auger shaft mount 28 are mounted above blade 16 on the left side. Auger cradle 20 and support post 26 are welded to blade 16.

A pivoting front pole cradle 40 consists of a horizontal member 42 and an upward angular member 44, preferably made of box aluminum. Horizontal member 42 is attached to the left side of blade 16 at pivot pin 46, shown in phantom. A horizontal steel swivel plate 48, shown in partial phantom, is welded to blade 16 and supports horizontal member in the deployed position. Pole cradle pivots behind blade 16 on pivot pin 46 when in a stowed position. An aperture 50 positioned at the end of angular member 44 is used to secure a cord around one or more poles 52 on front pole cradle 40. In one embodiment, horizontal member 42 is about 28 inches long and pivot pin 46 is about 4 to 5 inches in diameter. In another embodiment a second front pole cradle is mounted on the right side of blade 16 to carry poles on both sides. In a further embodiment, front pole cradle 40 is long enough to seat two poles side by side and support a third or fourth pole on top.

Figure 3:
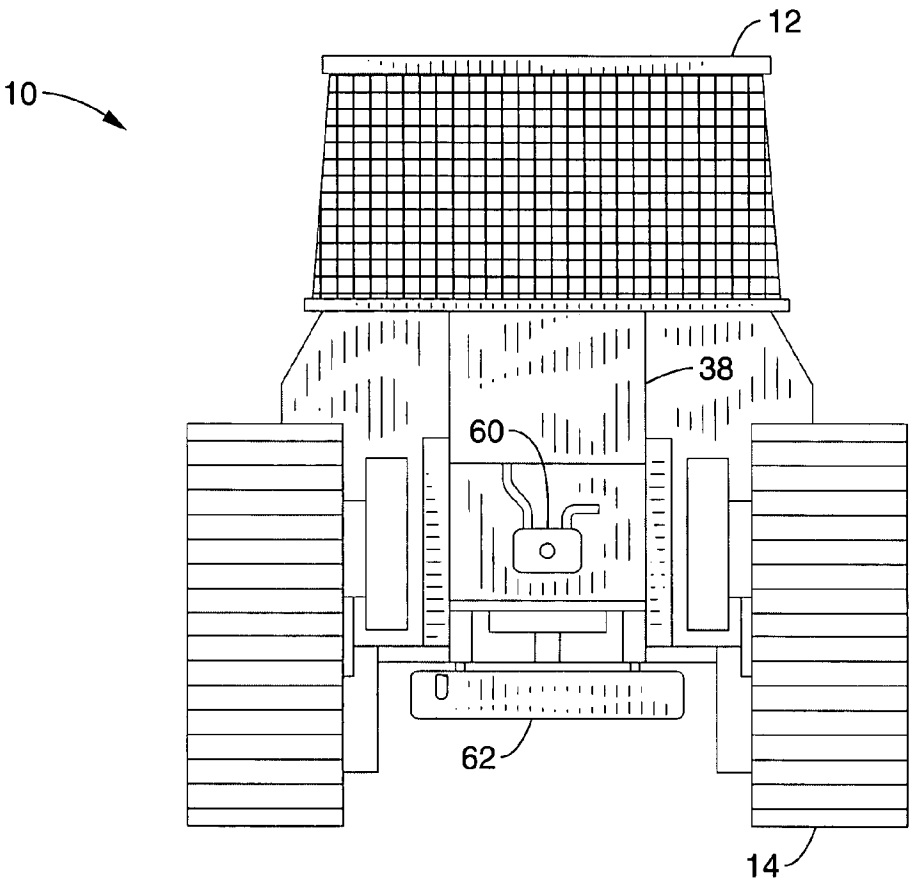
FIG. 3 is a rear view of the utility vehicle taken at line 3-3 in FIG. 1 showing the hydraulic tank, hydraulic pump and water tank.

FIG. 3 is a rear view of utility vehicle 10 taken at line 3-3 in FIG. 1 and with subframe 30 and crane assembly 36 removed for clarity. Hydraulic tank 38 is mounted behind the cab of vehicle 12 and is fluidly connected to hydraulic pump 60. In one embodiment, tank 38 is made of 10 gauge steel and is about 28 inches tall, about 50 inches wide and from 6 inches to about 12 inches deep with an internal baffle for strength. Hydraulic pump 60 is powered by a power takeoff from vehicle 12. In operation, hydraulic fluid is collected in tank 38 and pressurized by pump 60 for use by crane assembly 36 and auxiliary hydraulic powered equipment.

A water tank 62 is attached to the undercarriage of vehicle 12 and is fabricated from A36 ⅜ inch steel plate. In one embodiment, water tank 62 holds about 50 gallons of water and is about 60 inches long, 34 inches wide and about 4 inches deep. One or more internal baffles are provided for strength. A conventional means for filling the tank such as a fill tube and means for dispensing pressurized water through a hose, such as with a pump or pressurized air (not shown for clarity) are provided. Water is transported to the site by vehicle 12 and is used to cool and lubricate auger 22 during digging and to compact the soil when setting the pole.

Figure 4:
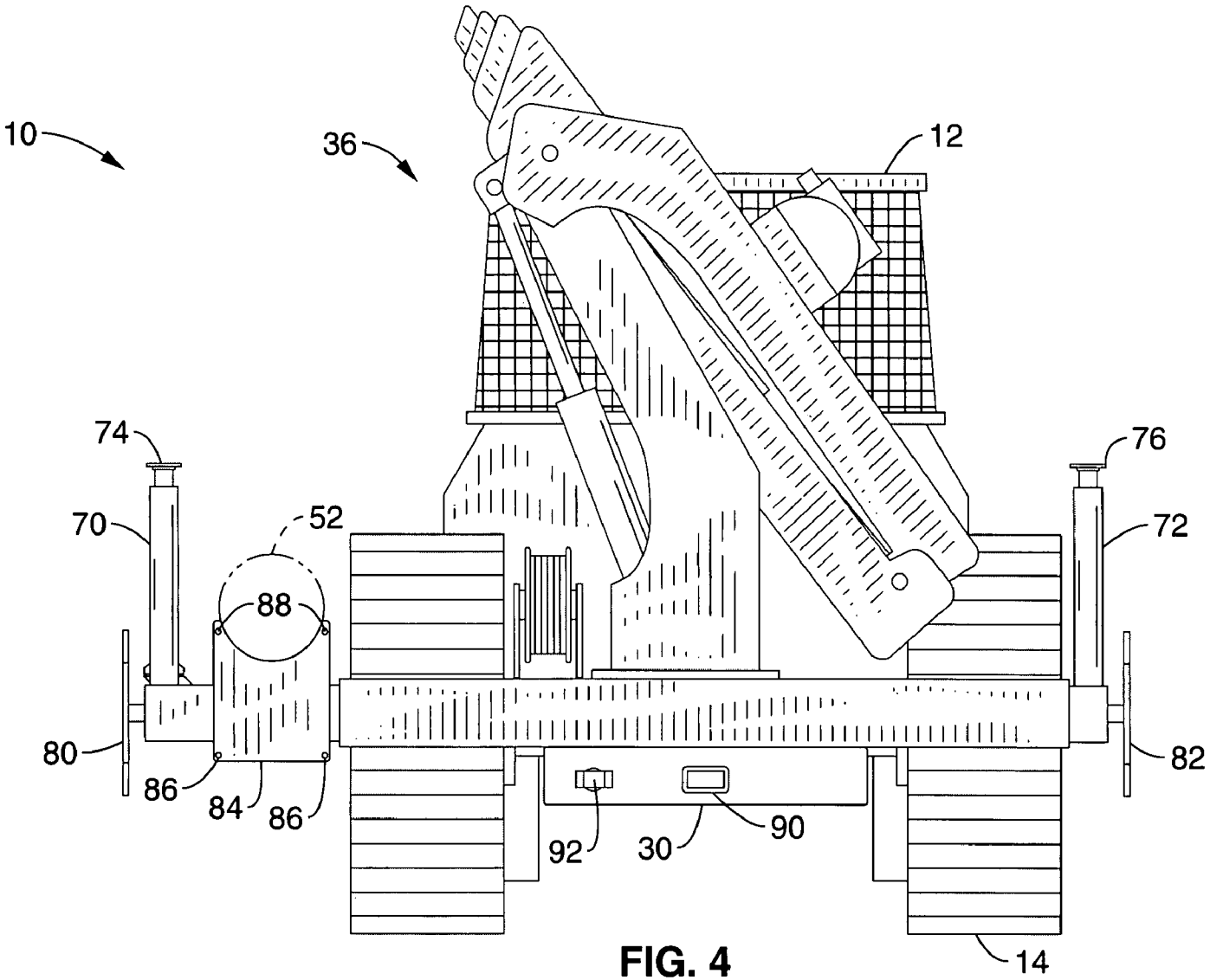
FIG. 4 illustrates a rear view of the utility vehicle shown in FIG. 1 in a mode for carrying a pole.

FIG. 4 illustrates the rear of utility vehicle 10 in a mode for carrying a pole 52. Crane assembly 36 mounted on subframe 30, has left outrigger 70 and right outrigger 72. Left, right outriggers 70, 72 are configured to slide horizontally outward, pivot downward and then extend left right feet 74, 76 to the ground. Large outrigger pads 80, 82 are shown mounted on the side of left, right outriggers 70, 72 and are attached to left right feet 74, 76 to provide additional support on soft surfaces. In a preferred embodiment, outrigger pads 80, 82 are about 16 inches square, have a pocket that slips over existing left, right feet 74, 76 and are secured with a pin. In one mode, outrigger pads 80, 82 are octagonal. Outrigger pads 80, 82 are preferably made of a stiff lightweight material for easy handling such as aluminum plate.

A removable rear pole cradle 84 is shown mounted on partially deployed left outrigger 70. Rear pole cradle 84 is configured as two plates with semi-circular cutouts forming a saddle that mounts over the horizontal bar of outrigger 70 and is secured at the bottom with removable pins through apertures 86. Pins 88 positioned at the top of rear pole cradle 84 are used to receive a cord to secure pole 52. In one embodiment, rear pole cradle 84 is made of ⅜ inch aluminum plate for ease of handling. In a further embodiment, rear pole cradle 84 is about 30 inches Wide, about 26 inches deep and spaced about 4 inches apart. In another embodiment a second front pole cradle and rear pole cradle are mounted on the right side of vehicle 12 to carry a pole on both sides. In a further embodiment, rear pole cradle 84 is wide enough to seat two poles side by side and support a third or fourth pole on top. Crane assembly 36 can be used to mount and dismount pole 52.

A cable winch 90 is shown mounted in the rear of subframe 30 and, in one embodiment, winch 90 is hydraulically powered with a capacity of 12,000 pounds. A mount 92 for a portable bucket yoke (described in FIG. 7) is also shown attached to the rear of subframe 30. The rear of subframe 30 can also be equipped with a towing receiver, tongue or hook (not shown) for a trailer. In a further contemplated embodiment, crane assembly 36 is mounted to subframe 30 with a shock absorbing mounting system for increased stability.

Figure 5:
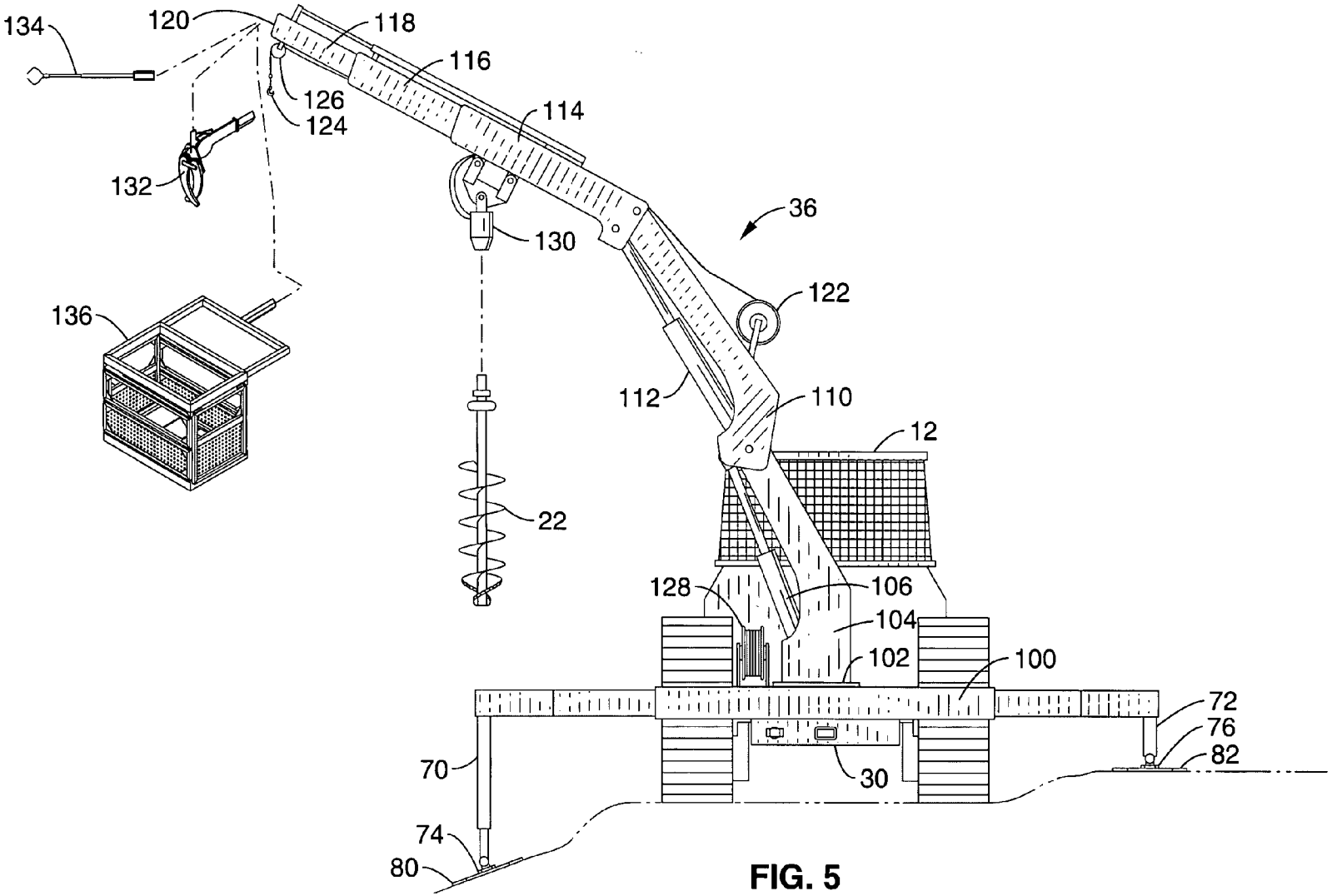
FIG. 5 is a rear view of the utility vehicle illustrated in FIG. 1 showing the crane in a deployed mode and crane attachments according to the invention.

FIG. 5 is a rear view of utility vehicle 10 showing crane assembly 36 in a deployed mode. Left, right outriggers 70, 72 are extended outward and rotated down to the ground. Outrigger pads 80, 82 have been attached to outrigger feet 74, 76 to provide better support on uneven or soft ground. In one mode, outriggers 70, 72 can be extended to about 21 feet apart.

Crane assembly 36 is illustrated as a folding knuckle boom crane as is known in the art and will not be described in detail. In one embodiment, crane assembly 36 is a Palfinger™ PK 26502 folding crane. A crane assembly that telescopes and folds into a compact profile behind vehicle 12 is preferred to minimize clearance requirements when traveling through dense vegetation. A vertical reach of about 85 feet and a side reach of about 75 feet is preferred for operations on remote high voltage and transmission lines. Crane platform 100 is mounted to subframe 30 on vehicle 12 and supports turret 102. Base boom 104 is articulated on turret 102 and supported by lift cylinder 106.

Intermediate boom 110 is articulated on base boom 104 and is supported by second cylinder 112. Folding arm 114 is articulated on intermediate boom 110 and supports lifting arm 116. A plurality of telescoping arms 118 are coupled to lifting arm 116. An elongated hexagonal or elongated diamond shaped tool receptacle 120 is positioned at the end of the last telescoping arm 116. Hydraulic supply and return lines for attachments (not shown)are available at tool receptacle 120. A winch 122 drives a cable 124 through a sheave 126 positioned at the end of the last telescoping arm 118. A hydraulic motor 130 is suspended from lifting arm 114 and is configured to drive an auger 22. In a preferred embodiment, hydraulic motor 130 has two or more speeds. Additional hydraulic supply lines for tools are located on reel 128 mounted on crane platform 100.

Crane assembly 36 has conventional hydraulic controls (not shown) on the crane platform 100. In a further embodiment, crane assembly 36 has a radio remote control console that allows the operator to start the engine of vehicle 12 (to power hydraulic pump 60) and manipulate the crane from up to 400 feet away. This allows safe operation of the crane near energized power lines, on steep, uneven terrain or from a personnel bucket mounted on the crane.

A lightweight pole grapple 132 is adapted to couple to tool receptacle 120 and is used to manipulate utility poles during setting. Pole grapple 132 will be described in more detail in FIG. 6.

One or more insulated lineman hot sticks 134 for manipulating switches and fuses are adapted to couple to tool receptacle 120.

A novel lightweight folding personnel bucket assembly 136 is adapted to couple to tool receptacle 120 and will be described in more detail in FIG. 7 through FIG. 8C.

Crane assembly 36 and subframe 30 can be separated from tracked vehicle 12 in the field to provide additional flexibility for road building and maneuvering. With outriggers 70, 72 extended outward and on the ground, telescoping arm 118 is positioned on the ground to form a three leg support for crane platform 100. Subframe 30 is dismounted from tracked vehicle 12 by removing upper, lower support pins 32, 34 shown in FIG. 1. Crane hydraulic lines coupled to hydraulic tank 38 and pump 60 (shown in FIG. 3) are disconnected. Tracked vehicle 12 can be driven away from crane assembly 36 for road building or other tasks better accomplished without the crane. Crane assembly 36 can be remounted to track vehicle 12 in the field by reversing the above procedure and using the crane and outriggers for final alignment of support pins 32, 34. A rear mounted camera and sound system (not shown) can be mounted on vehicle 12 to safely facilitate crane mounting and demounting. The sound system allows the vehicle driver to be instructed verbally by outside personnel.

Figure 6:
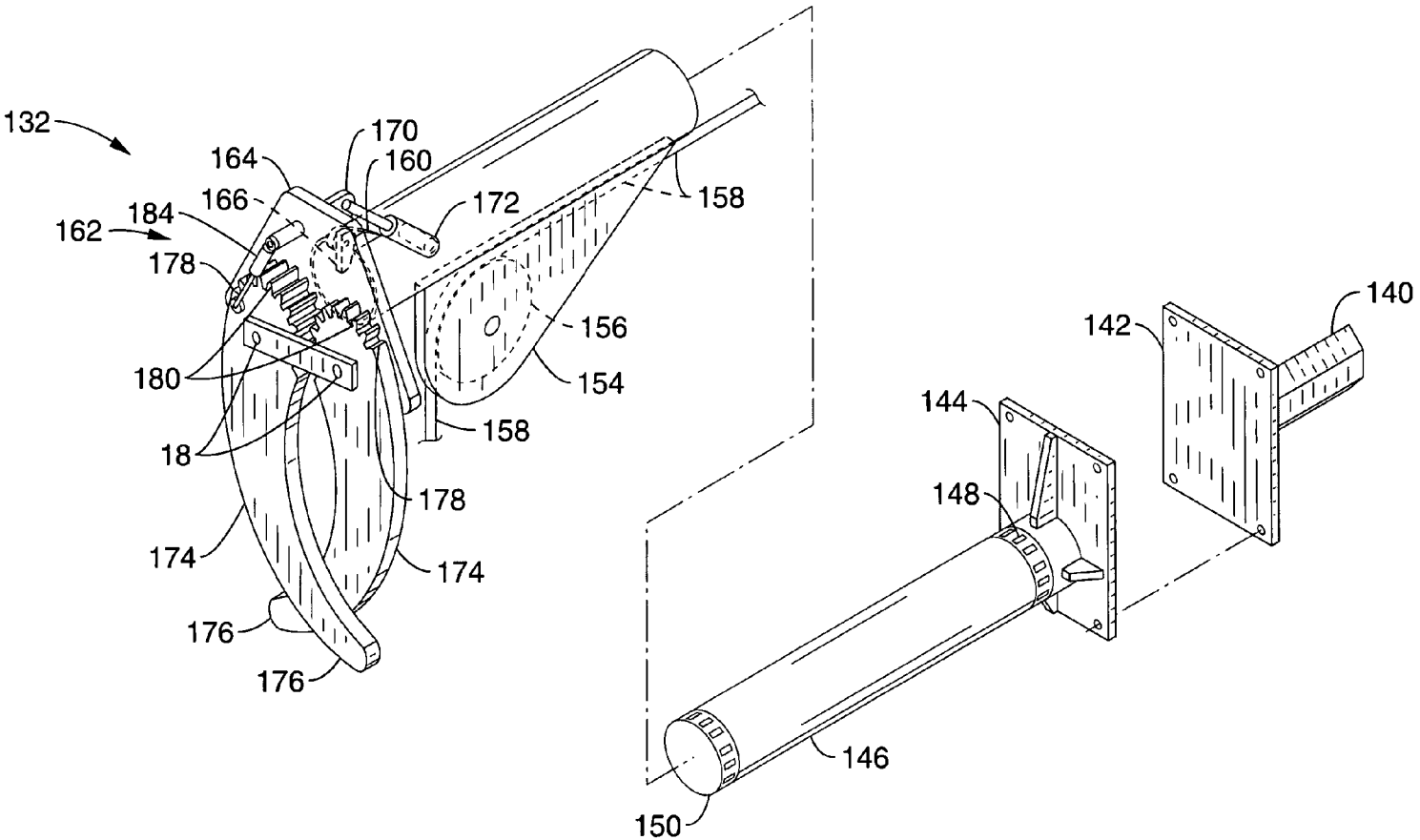
FIG. 6 illustrates an exploded view of a pole grapple according to the invention.

FIG. 6 illustrates an exploded view of pole grapple 132 shown in FIG. 5. Crane mount 140 is configured to attach to tool receptacle 120 of crane assembly 32 and has flange 142 that couples to flange 144 of spindle 146. Spindle 146 is about 4 inches in diameter and has outer bearing 148 and inner bearing 150. Hub 152 is about 4½ inches in diameter and is supported on spindle 146 so that it can freely rotate. Spindle 146 and hub 152 are coupled together with a rotating collar, center tie rod or other conventional means (not shown). Hub 152 may also have grease fittings (not shown) for lubrication of the bearings.

Sheave housing 154 is attached to the bottom of hub 152 and is generally two parallel plates supporting sheave 156 that also guides cable 158 from the crane. Cable 158 can be used to lift and position the pole. In one embodiment, cable 158 is the same as cable 124 attached to crane assembly 36 shown in FIG. 5.

Pivot bracket 160 is attached to the top of hub 152 and supports pole pincher assembly 162. Pincher assembly 162 has a base plate 164 with a support bracket 166 coupled in back near the center of base plate 164 that attaches to pivot bracket 160. Elevation bracket 170 is attached to the top of base plate 164 in back and couples to the spindle of elevation cylinder 172. The base of elevation cylinder 172 is coupled to sheave housing 154.

Opposing grapple blades 174 have a scroll shape that is narrow at the blade tips 176 and wider and rounded at blade base 178. Each rounded blade base 178 has interlocking teeth 180 equidistant from blade pivot pins 182 in base plate 164. Pivot cylinder 184 is coupled to base plate 164 and to the base 178 of one grapple blade 174.

Movement of pivot cylinder 184 causes both grapple blades 174 to act in unison to open or close. Movement of elevation cylinder 172 causes grapple blades 174 to articulate between vertical downward and horizontal. Additionally, hub 152 can rotate freely on spindle 146. This allows grapple 132 to engage and move a pole that may be oriented askew from the crane or on uneven terrain.

Grapple 132 can position a pole vertically by engaging it just above its center of gravity. Thus the grapple can set a pole that is just under twice the vertical limit of the crane. For example this grapple can set about a 140 foot pole using a crane with an 80 foot vertical reach.

In one embodiment, the majority of components of pole grapple 132 except spindle 146 are made from lightweight material such as aluminum so that pole grapple 132 weighs about 100 pounds and can be mounted to the crane by one or more persons without lifting equipment. In another embodiment (not shown), grapple 132 is mounted on hydraulic tank 38 when not in use. In a preferred embodiment, grapple 132 can be manipulated by the crane remote control console described in FIG. 5.

Figure 7:
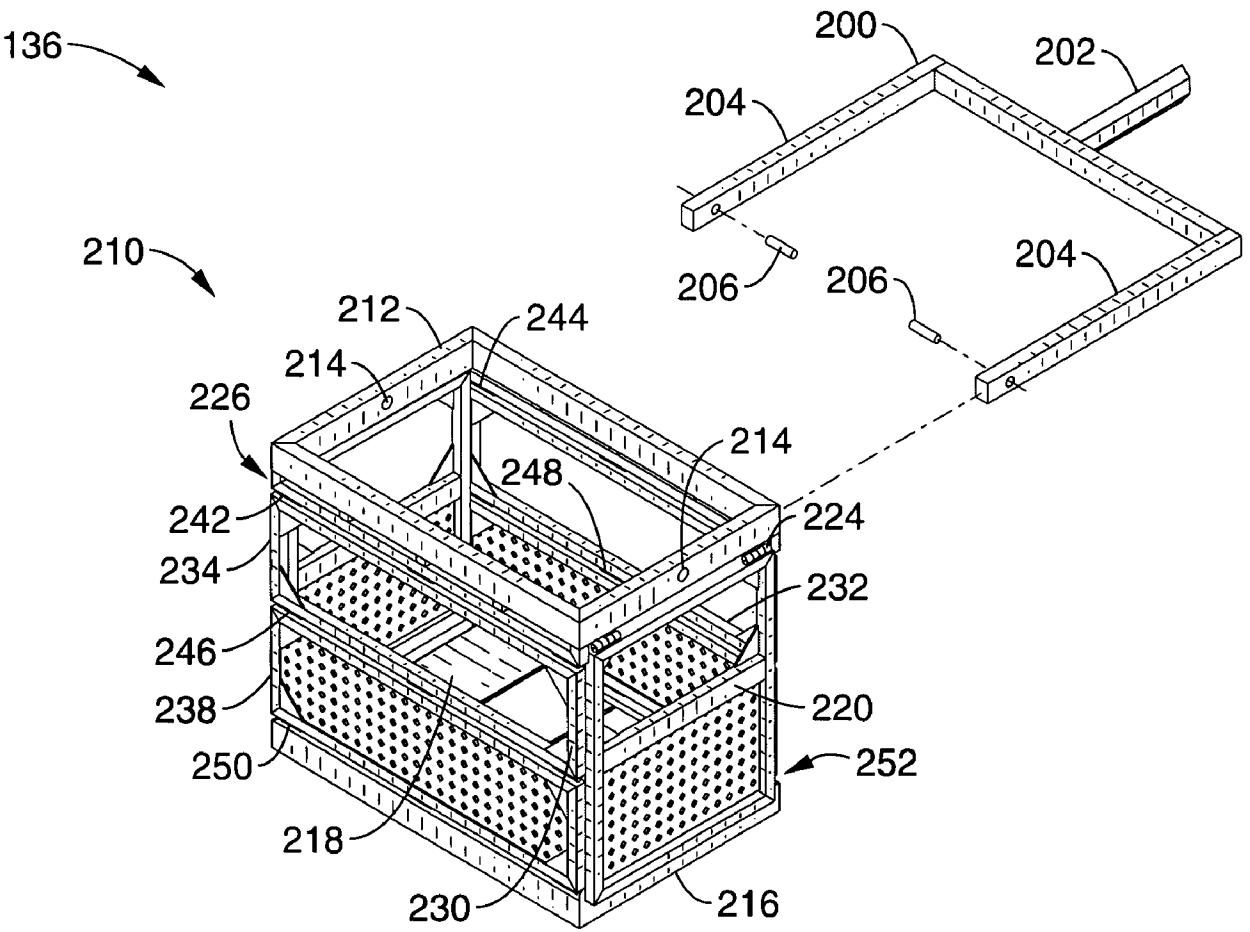
FIG. 7 illustrates a perspective view of a collapsible personnel bucket assembly according to the invention.

FIG. 7 illustrates a perspective view of bucket assembly 136 shown in FIG. 5. Yoke 200 has a tongue 202 that is configured to coupled to tool receptacle 120. Yoke fork 204 has pivot pins 206 at the ends. In one embodiment, the cross-piece of yoke 200 is 5×5×¼ inch box aluminum. Fork 204 is made of 2×2×½ box aluminum reinforced with gussets to increase rigidity. The tongue 202 is about six feet long.

Collapsible bucket 210 has rectangular top frame 212 with apertures 214 on the short sides of top frame 212 that mate with pivot pins 206. In one embodiment, locking cams or other devices are provided at apertures 214 to prevent bucket 210 from rocking on pivot pins 206. Rectangular bottom frame 216 has a floor 218. First, second short sides 220, 222 are coupled to top frame 212 with first, second hinges 224, 226.

Third, fourth long sides 230, 232 have upper panels 234, 236 and lower panels 238, 240. In the illustrated embodiment, upper panels 234, 236 are open and reinforced with gussets. Lower panels 238, 240 are a perforated or expanded lightweight metal screen such as aluminum. In one embodiment, lower panels, 238, 240 have a 4 inch high toe kick panel at the bottom (not shown). Upper panels 234, 236 have third, fourth top hinges 242, 244 coupled to top frame 212. Third, fourth middle hinges 246, 248 couple upper panels 234, 236 to lower panels 238, 240. Third, fourth bottom hinges 250, 252 couple lower panels 238, 240 to bottom frame 216. In a preferred embodiment, all the components of collapsible bucket 210 except hinges are made of lightweight aluminum.

In one embodiment, the inside of collapsible bucket 210 is about 30 inches wide, about 48 inches long, and can accommodate 2 persons. It is about 45 inches tall from the top of top frame 212 to the top of bottom frame 216. Top frame 212 is made from 2×8 inch box aluminum and bottom frame 216 is made from 2½×1½ inch box aluminum. Floor 218 is made from 10 gauge aluminum plank with an anti-slip surface. In this embodiment, collapsible bucket assembly 136 with yoke 200 attached weighs about 350 pounds. In another embodiment, floor 218 can be a grate.

In operation, collapsible bucket 210 is erected and yoke tongue 202 is coupled to tool receptacle 120 of the crane. A radio remote control console (described in FIG. 5) can be used by a person in the bucket to direct the crane and bucket. Conventional controls on the crane can be used by a second person to position the bucket.

Figure 8B:
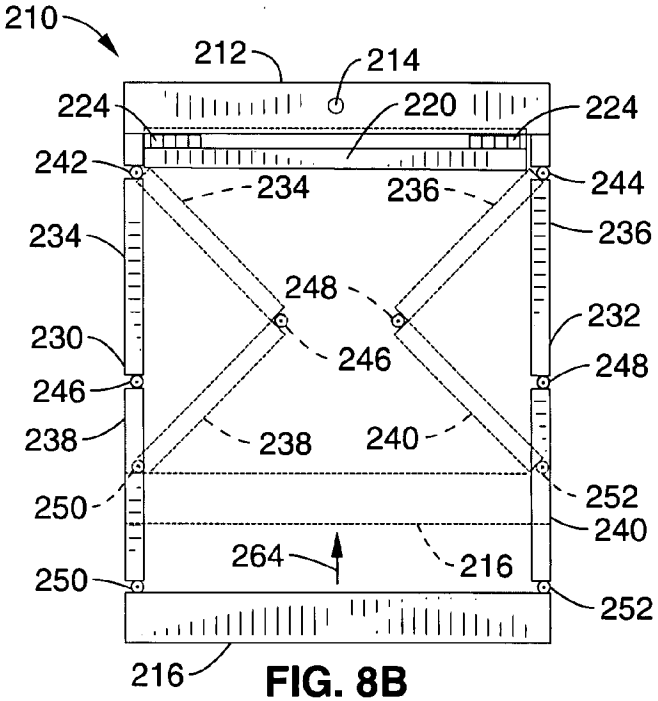
FIG. 8B is an end view of the collapsible personnel bucket shown in FIG. 7 moving to a collapsed position.
Figure 8A:
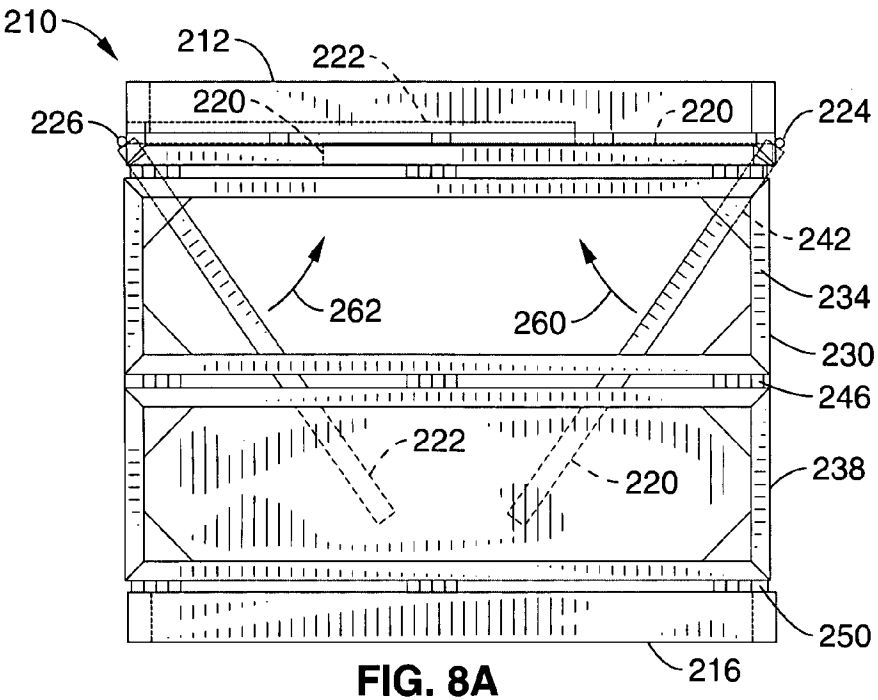
FIG. 8A is a side view of the collapsible personnel bucket shown in FIG. 7 moving to a collapsed position.
Figure 8C:
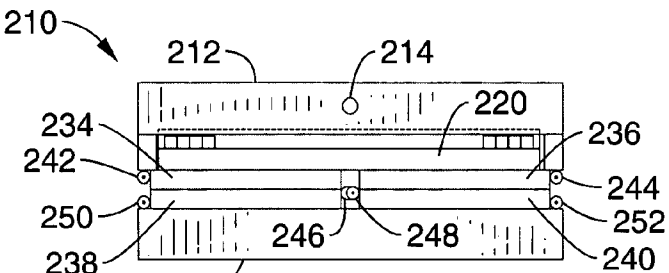
FIG. 8C is an end view of the collapsible personnel bucket shown in FIG. 7 in a collapsed position.

FIG. 8A through FIG. 8C illustrate collapsible bucket 210 shown in FIG. 7 moving from an erect position into a collapsed position. Note that in operation, bucket 210 is supported by top frame 212 and weight on floor 218 keeps bucket 210 in an erect position.

Referring to FIG. 8A, a side view shows first short side 220 folded upward on hinge 224 as designated by arrow 260. Second short side 222 is similarly folded up on hinge 226 as designated by arrow 262. Both first second short sides 220, 222 are folded parallel to top frame 212. In one embodiment, the bottom edge of first, second short sides 220, 222 have pins or bolts (not shown) that engage bottom frame 216 to help transfer load from floor 218 to top frame 212.

FIG. 8B is an end view showing first short side 220 folded parallel to top frame 212. Third, fourth long sides 230, 232 are shown folding at third, fourth center hinges 246, 248 and bottom frame 216 moving upward as designated by arrow 264.

FIG. 8C shows collapsible bucket 210 in a fully collapsed position. In one embodiment, collapsed bucket 210 remains on yoke 200 and tongue 202 seats in bucket mount 92 shown in FIG. 4. In a further embodiment, fully collapsed bucket 210 is mounted on the roof of vehicle 12 during transport.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for installing utility poles in a remote location comprising:

a tracked vehicle configured for operating in remote locations having steep, uneven terrain;

said tracked vehicle having a front and rear;

a movable blade attached to the front of said vehicle;

wherein said blade is configured to clear and scrape a right of way;

an auger mount attached to said blade;

wherein said auger mount is configured to support an auger bit while said tracked vehicle is in motion;

a subframe coupled to the rear of said tracked vehicle;

a folding crane mounted on said subframe;

wherein said crane is configured to manipulate a utility pole; and wherein said crane is further configured to drive an auger bit.

2. An apparatus as recited in claim 1, further comprising:

first and second outriggers mounted on said crane;

a front pole cradle mounted on said blade; and a rear pole cradle mounted on said first outrigger;

wherein said front, rear pole cradles are configured to carry a utility pole.

3. An apparatus as recited in claim 2:

wherein said rear pole cradle is removably attached to said first outrigger; and wherein said front pole cradle is pivotally attached to said blade.

4. An apparatus as recited in claim 2:

wherein said crane has an articulating member;

wherein said subframe with said crane attached is removably attached to said tracked vehicle with a plurality of removable pins;

wherein said subframe is removable from said tracked vehicle by removing said pins and moving said tracked vehicle from said subframe;

wherein said subframe and said crane are supported on said first, second outriggers and said articulating member when removed from said tracked vehicle; and wherein said subframe is reattached to said tracked vehicle by aligning said tracked vehicle with said subframe and inserting said pins.

5. An apparatus as recited in claim 4, further comprising:

a hydraulic power source attached to said tracked vehicle;

wherein said hydraulic power source is configured to power said crane;

wherein said crane can be powered by said hydraulic source when said subframe is removed from said tracked vehicle; and wherein moving said articulating member will align said subframe with said vehicle when said subframe is removed from said vehicle.

6. An apparatus as recited in claim 1, further comprising:

a water tank mounted on said vehicle;

means for filling said water tank; and means for dispensing water from said water tank.

7. An apparatus as recited in claim 1, further comprising:

a grapple removably attached to said crane;

wherein said grapple is configured to rotate on a hubs and wherein said grapple is configured to grasp a utility pole.

8. An apparatus as recited in claim 1, further comprising:

a personnel bucket removably attached to said crane.

9. An apparatus as recited in claim 1, further comprising a remote control device configured for controlling said crane from a position remote from said vehicle.

10. In a tracked vehicle configured for operating in steep, uneven terrain having a movable blade coupled to the front, the improvement comprising:

an auger mount attached to said blade;

wherein said blade is configured for clearing and scraping a road;

wherein said auger mount is configured to support an auger bit when the tracked vehicle is in motion;

said tracked vehicle having a rear mount;

a subframe attached to said rear mount;

a folding crane mounted on said subframe; and a hydraulic power source attached to said tracked vehicle;

wherein said hydraulic power source is configured to power said crane;

wherein said crane is configured to manipulate a utility pole; and wherein said crane is further configured to drive an auger bit.

11. An improvement as recited in claim 10, further comprising:

first and second outriggers attached to said crane;

a front pole cradle attached to said blade; and a rear pole cradle attached to said first outrigger;

wherein said front, rear pole cradles are configured to carry a utility pole.

12. An improvement as recited in claim 11:

wherein said rear pole cradle is removable from said first outrigger; and wherein said front pole cradle is further configured to pivot behind said blade.

13. An improvement as recited in claim 10, further comprising:

first and second outriggers attached to said crane;

wherein said crane has an articulating member;

wherein said subframe with said crane attached is removably attached to said tracked vehicle with a plurality of removable pins;

wherein said subframe is removable from said tracked vehicle by removing said pins and moving said tracked vehicle from said subframe;

wherein said subframe and said crane are supported on said first, second outriggers and said articulating member when removed from the tracked vehicle;

wherein said subframe is reattached to said tracked vehicle by aligning said tracked vehicle with said subframe and inserting said pins; and wherein moving said articulating member will align said subframe with said vehicle when said subframe is removed from said vehicle.

14. An improvement as recited in claim 10, further comprising:

a water tank mounted on said vehicle;

means for filling said water tank; and means for dispensing water from said water tank.

15. An improvement as recited in claim 10, further comprising:

a grapple removably attached to said crane;

wherein said grapple is configured to rotate on a horizontal axis; and wherein said grapple is configured to grasp a utility pole.

16. An improvement as recited in claim 10, further comprising:

a collapsible personnel bucket attached to said crane;

said bucket having a top frame and a floor;

said personnel bucket having a pair of long sides and a pair short sides positioned between said top frame and said floor;

said short sides hinged at said top frame;

said long sides hinged at their center;

said long sides hinged at said top frame and at said floor;

said bucket having an erect position and a collapsed position;

wherein said short sides are configured to fold inward and parallel to said top frame when said bucket is in said collapsed position; and wherein said long sides are configured to fold inward at their center when said bucket is in said collapsed position.

* * * * *